US007914319B2

(12) United States Patent
Jones et al.

(10) Patent No.: US 7,914,319 B2
(45) Date of Patent: Mar. 29, 2011

(54) INTERCONNECTOR SYSTEM ENGAGEMENT SENSOR

(75) Inventors: Tom Jones, Madison, AL (US); John Perry, Huntsville, AL (US)

(73) Assignee: Continental Automotive Systems US, Inc., Auburn Hills ( * ) Notice: Subject to any disclaimer, the term of this patent is extended or adjusted under 35 U.S.C. 154(b) by 236 days.

(21) Appl. No.: 12/166,600

(22) Filed: Jul. 2, 2008

(65) Prior Publication Data

US 2009/0035985 A1 Feb. 5, 2009

Related U.S. Application Data

(60) Provisional application No. 60/958,205, filed on Jul. 3, 2007.

(51) Int. Cl.
*H01R 3/00* (2006.01)

(52) U.S. Cl. ..... 439/489; 439/490

(58) Field of Classification Search ..... 439/188, 439/488–490

See application file for complete search history.

(56) References Cited

U.S. PATENT DOCUMENTS

| | | | | |
|---|---|---|---|---|
| 5,055,058 | A | 10/1991 | Nagasaka et al. | |
| 5,601,442 | A * | 2/1997 | Harting et al. | 439/188 |
| 5,651,685 | A | 7/1997 | Brinkman et al. | |
| 5,651,693 | A | 7/1997 | Fukuda et al. | |
| 5,876,238 | A | 3/1999 | Thomsen | |
| 5,899,764 | A * | 5/1999 | Harting et al. | 439/188 |
| 2001/0049221 | A1 | 12/2001 | Abbott | |

OTHER PUBLICATIONS

International Preliminary Report on Patentability mailed on Jan. 14, 2010.

International Search Report and Written Opinion mailed Feb. 26, 2009.

* cited by examiner

*Primary Examiner* — Xuong M Chung Trans

(57) ABSTRACT

An electrical connector assembly includes a housing supporting a plurality of terminals for a primary circuit and at least two terminals for a sensor circuit. A mating header includes terminals corresponding to the primary circuit and to the sensor circuit. A conductive link is disposed in either the housing or the header to short the sensor terminals disposed therein. Once the mating components of the connector are attached, the sensor circuit is completed through the conductive link and an indication of a proper connection can be verified.

21 Claims, 6 Drawing Sheets

INTERCONNECTOR SYSTEM ENGAGEMENT SENSOR

CROSS REFERENCE TO RELATED APPLICATION

The application claims priority to U.S. Provisional Application No. 60/958,205 which was filed Jul. 3, 2007.

BACKGROUND OF THE INVENTION

This disclosure generally relates to an electrical connector assembly. More particularly, this invention relates to an electrical connector assembly including features to positively verify proper electrical connection.

An electrical connection assembly typically includes a housing supporting several connecting terminals of a connecting cable. The terminals engage mating terminals of another connector or printed circuit board. The housing may include a locking feature that snaps in place. In such cases, an installer relies on the sound and feel of the housing locking into place. Disadvantageously, surrounding noises may not allow the audible sound of the housing locking in place to be heard. Further, an installer feeling that the connection is properly seated is not reliable.

Accordingly, it is desirable to design and develop a method and connector assembly that provides a positive verifiable indication of a proper electrical connection.

SUMMARY OF THE INVENTION

A disclosed electrical connector assembly includes a conductive link that completes a sensor circuit when a desired electrical connection is completed.

The example electrical connector assembly includes a housing supporting a plurality of terminals for a primary circuit and at least two terminals for a sensor circuit. A mating header includes terminals corresponding to the primary circuit and to the sensor circuit. A conductive link is disposed in either the housing or the header to short the sensor terminals disposed therein. Once the mating components of the connector are attached, the sensor circuit is completed through the conductive link and an indication of a proper connection can be verified.

A disclosed example housing includes shorted sensor terminals that complete a sensor circuit on a circuit board supporting the header. The header includes mating terminals electrically connected to traces on the circuit board. The traces form an open circuit until the housing is assembled to the header. The shorted terminals within the header complete the circuit to provide the desired indication of a proper electrical connection.

Alternatively, an electrical component from which the housing originates includes the sensor circuit. The sensor terminals in the housing are not shorted. The header is supported on a circuit board that includes a circuit trace that shorts the two corresponding terminals to each other. Engaging the terminals in the housing with the shorted terminals in the circuit board completes the circuit and provides the desired verification of a proper engagement and seating of the electrical connector.

Accordingly, the example electrical connector provides a positive verification of a desired electrical connection.

These and other features of the present invention can be best understood from the following specification and drawings, the following of which is a brief description.

DETAILED DESCRIPTION OF THE PREFERRED EMBODIMENT

Figure 1:
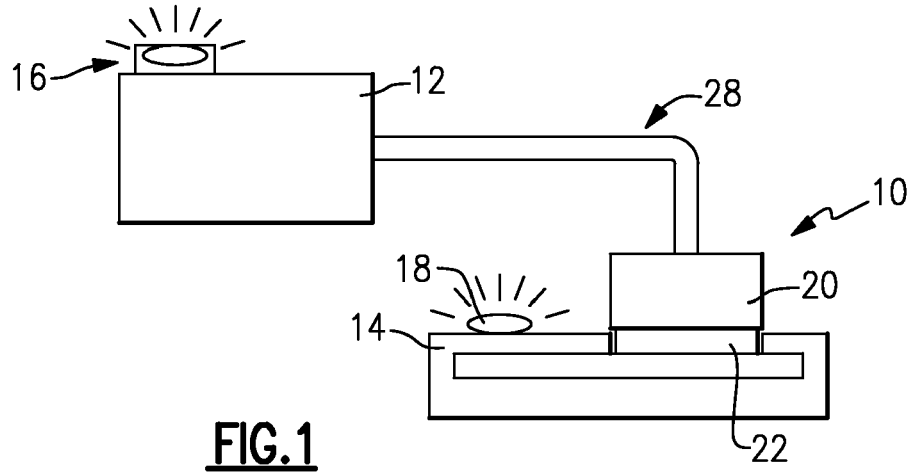
FIG. 1 is a schematic view of an example electrical connector assembly.

Referring to FIG. 1, an example electrical connector assembly 10 provides an electrical connection between a first electrical component 12 and a second electrical component 16 and includes features to verify continuity. The connector assembly 10 includes a housing 20 that engages a header 22. A plurality of wires 28 disposed in a cable are terminated in the housing 20 and provide the electrical conduit between the first and second components 12, 14. The electrical connection is verifiable through indicators 14, 16. The example indicator 14, 16 is a light that is actuatable to verify the integrity of the electrical connection. Other indicator devices and signals could be utilized to provide the desired verification of the electrical connection.

Figure 2:
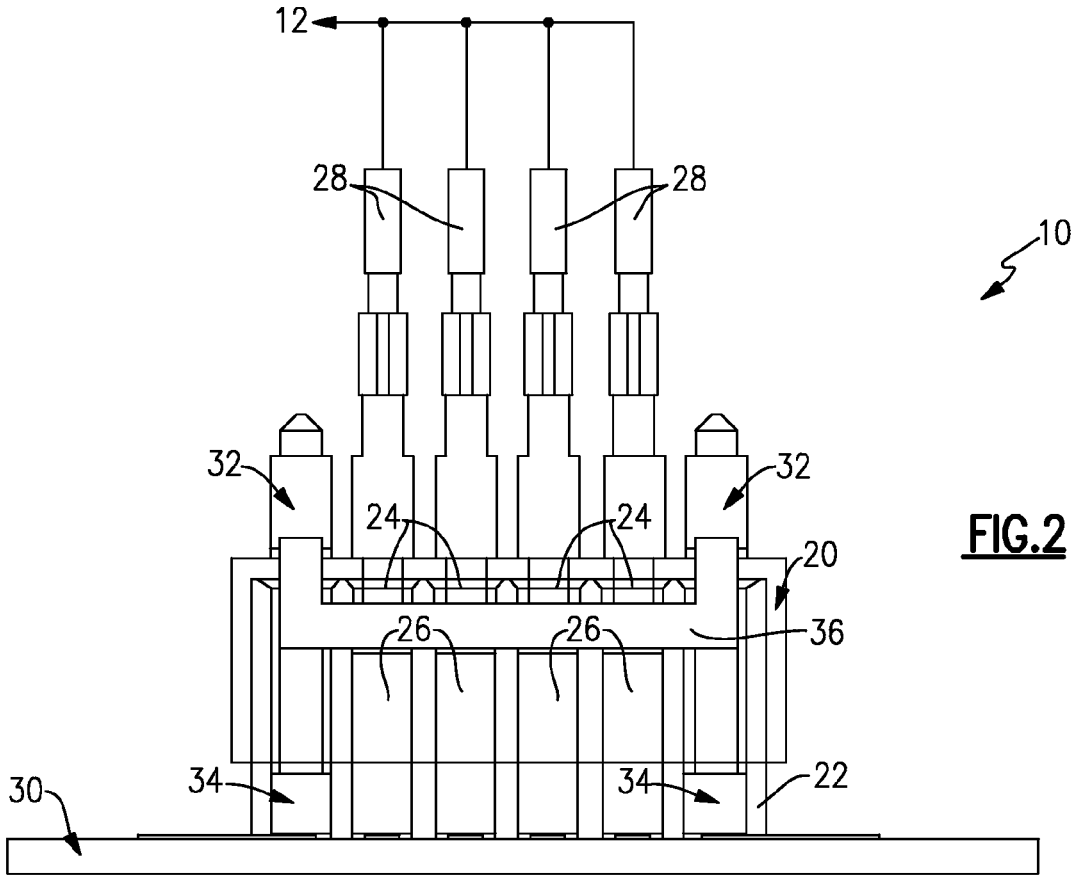
FIG. 2 is a side view of an example electrical connector assembly.
Figure 3:
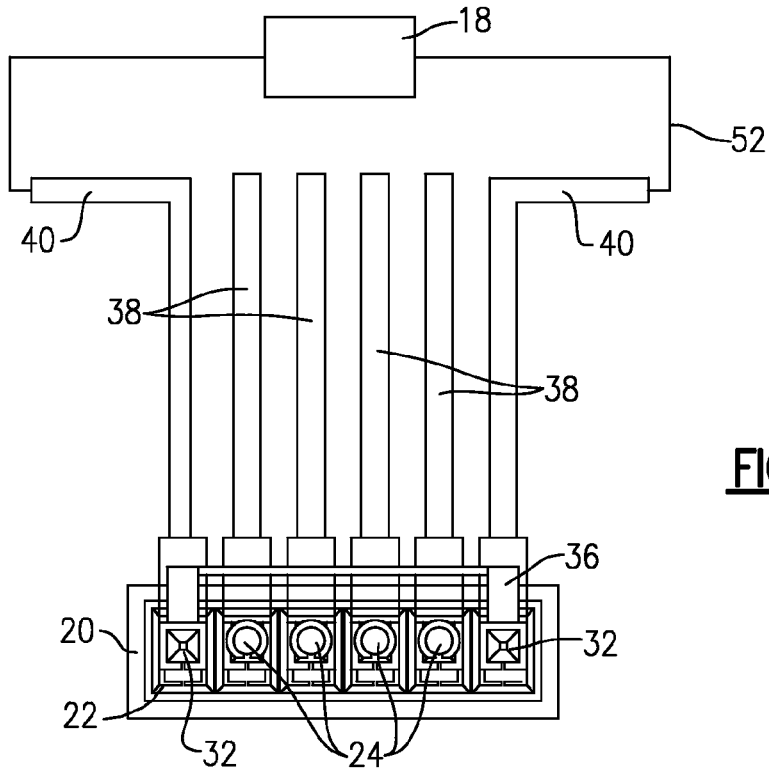
FIG. 3 is a top view of the example electrical connector assembly.

Referring to FIGS. 2 and 3, the example connector assembly 10 includes a plurality of primary circuit pins 24 supported within the housing 20 that terminate ends of the wires 28. Sensor pins 32 are supported within the housing 20 and are shorted to each other through a conductive link 36. The sensor pins 32 do not include a connection to wires back through the cable.

The example conductive link 36 is a metal trace supported within the housing 20. The housing 20 engages a header 22 that supports a plurality of sockets 26 that receive corresponding ones of the circuit pins 24. The example header 22 is supported on a circuit board 30 that includes a plurality of primary circuit traces 38 that are electrically connected to the sockets 34. The header 22 further supports sensor sockets 34 that receive the corresponding one of the sensor pins 32.

The circuit board 30 includes traces 40 of a sensor circuit 52 that provide for the actuation of the indicator 18 upon engagement with the sensor pins 32. The sensor circuit 52 is in an open condition until the housing 22 is connected to the header 22. When the housing 22 is connected to the header 22, the shorted sensor pins 32 complete the sensor circuit 52 by providing the electrical connection between traces 40. The example sensor circuit 52 is disposed within the second component 14 and provides an indication that the housing 20 is properly seated on the header 22.

Figure 4:
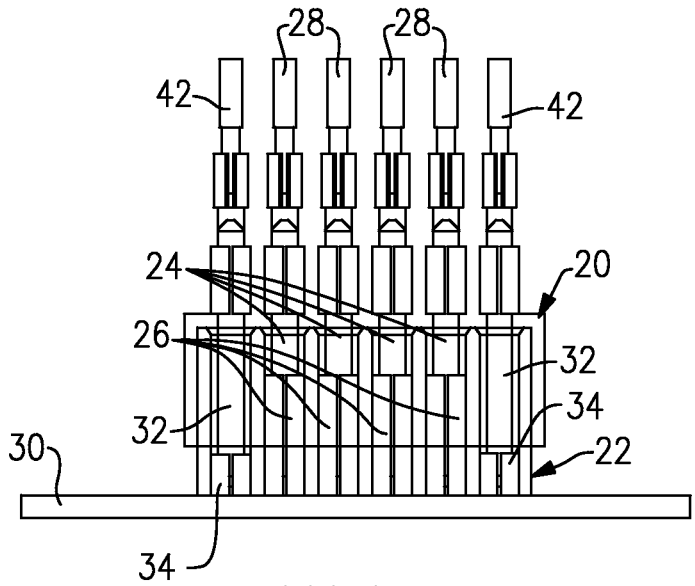
FIG. 4 is a side view of another example electrical connector assembly.
Figure 5:
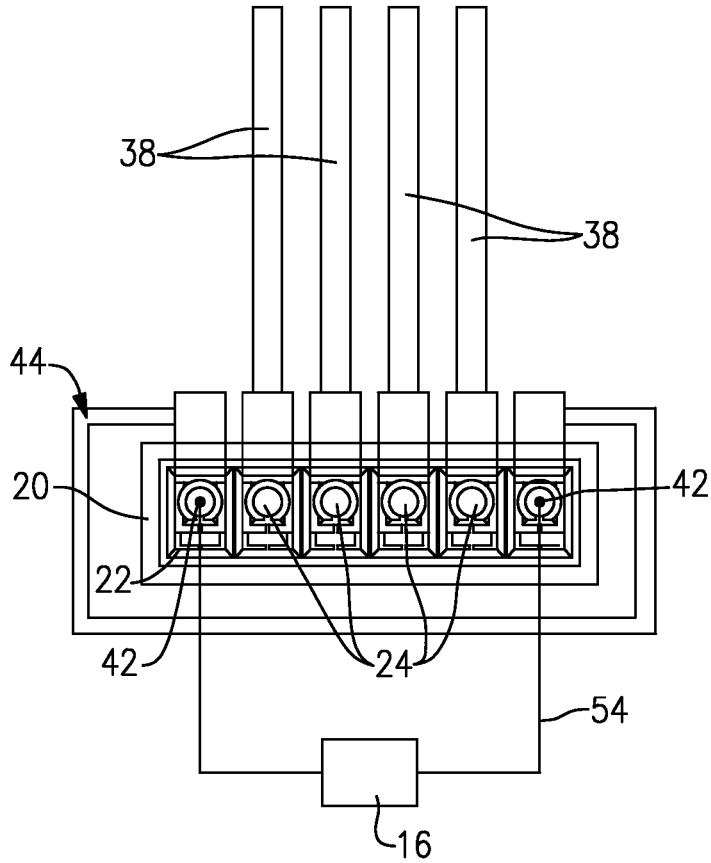
FIG. 5 is a top view of the example electrical connector assembly of FIG. 4.

Referring to FIGS. 4 and 5, another connector assembly 46 includes the sensor circuit 54 disposed in the first component 12. The example housing 20 supports the sensor pins 32 that are connected to wires 42. The wires 42 extend through the cable back to the first component 12. The sensor pins 32 are received within the corresponding sensor sockets 34 supported by the header 22. The sensor pins 32 in the example connector assembly 46 are not shorted to each other. Instead, a sensor circuit 54 disposed within the first component 12 is completed to actuate the indicator 16 once the housing 20 is mated to the header 22.

The header 22 is disposed on the circuit board 30 and includes the primary circuit traces 38. A sensor trace 44 is disposed to short the two sensor sockets 34. Therefore, once the sensor pins 32 are received within the sensor sockets 34, the sensor circuit 54 is complete and the indicator 16 is actuated. Although the disclosed example includes pins 24 disposed within the housing 20 and sockets within the header 22, the housing 20 could be configured to house sockets that would correspond to pins supported within the housing. Further, other electrical connection terminals as are known in the art could also be utilized to provide the desired electrical connections and continuity.

The example indicators 16, 18 are lights that are lit to indicate a proper connection. However, other indicators may be utilized, such as the lack of an error code, or provide communication to contacts located to provide for meter testing. Further, the sensor circuit may provide a signal that is utilized by a controller or other device utilized for diagnosing faults. Alternatively, a meter device may be utilized to verify the interconnection of the connector assembly by engaging the housing terminals. Further, it is within the contemplation of this invention that the indicator be any method or device that provides a positive verification that the connector assembly is properly seated.

Figure 6:
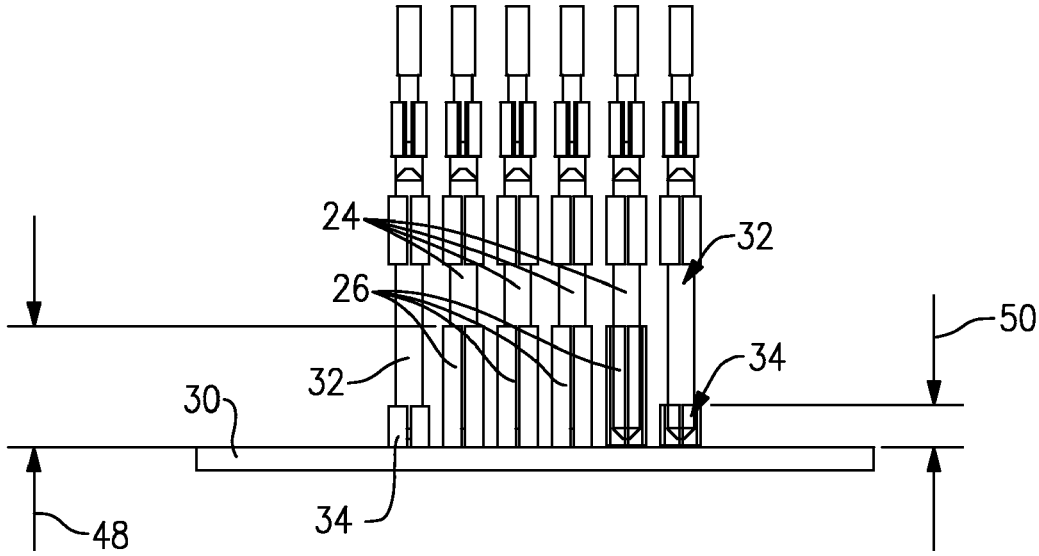
FIG. 6 is a side view of an interface between terminals of the example electrical connector assembly.

Referring to FIG. 6, the example sockets 26 for the primary circuit include a length 48 and the sensor sockets 34 include a length 50 smaller than the length 48. This provides for engagement of the primary circuit pins 24 before engagement between the sensor pins 32 and sockets 34. The different lengths 48, 50 provides for engagement of the sensor pins 32 to the sockets 34 to accommodate tolerance stack up conditions. Therefore, when the sensor pins 32 are seated within the sensor sockets 34, a desired electrical connections can be substantially assured between the pins 24 and sockets 26 of the primary circuit.

The sensor pins 32 are disposed on each end of the connection assembly 10 to prevent a rocked connection from providing a false indication of a good connection. However, the sensor pins 32 can be disposed in any location relative to the primary circuit pins 24 as is desired to provide and assure continuity. Additionally, although two sensor pins 32 and corresponding sensor sockets 34 are disclosed, more sensor pins could be included to provide a further indication and verification of continuity.

Figure 7:
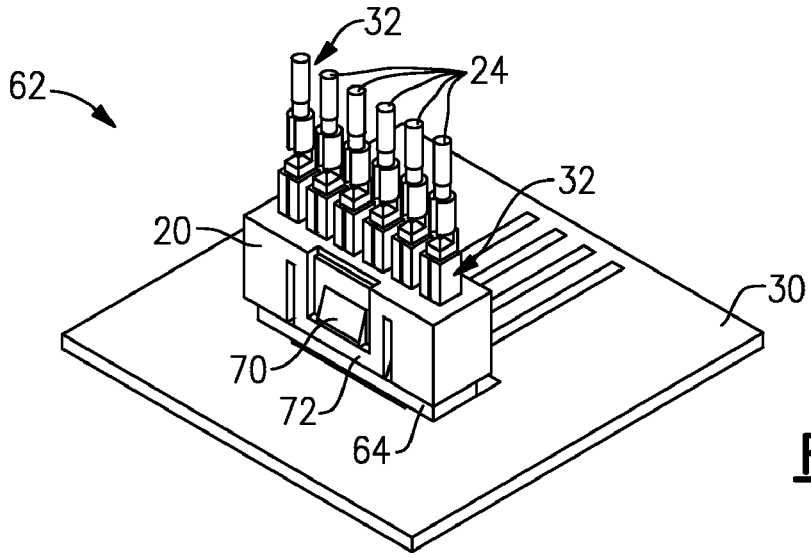
FIG. 7 is a perspective view of another electrical connector assembly.
Figure 8:
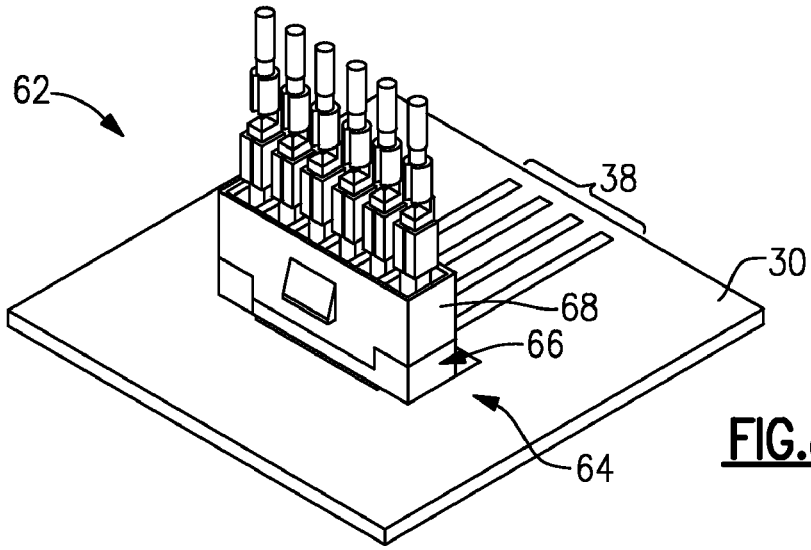
FIG. 8 is another perspective view of the example electrical connector assembly with a portion of the housing.
Figure 9:
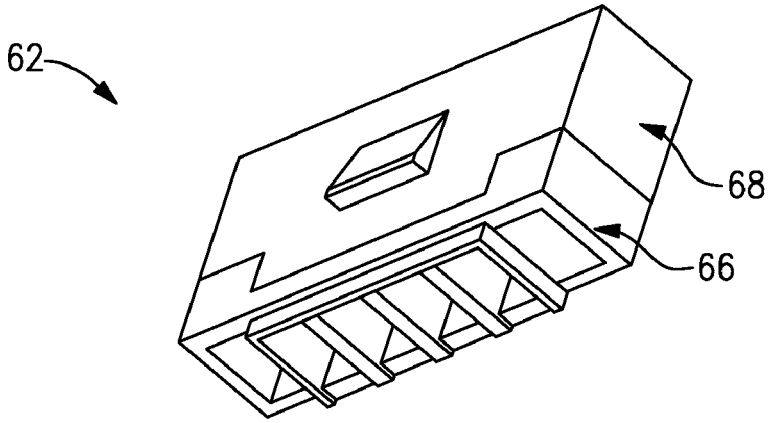
FIG. 9 is a perspective view of an example header including a conductive plastic portion.

Referring to FIGS. 7, 8 and 9, another example connector assembly 62 includes a header 64 mounted to the circuit board 30 that includes an electrically conductive plastic link 66. The electrically conductive plastic link 66 is utilized instead of a current trace on the circuit board 30 to provide the desired short between the sensor pins 32. The example header 64 includes a plastic portion 68 that engages the conductive plastic link 66. Sensor sockets 34 are in electrical contact with the conductive plastic link 66 such that continuity between sensor sockets 34 is provided. Therefore, once the sensor pins 32 are received within the sensor sockets 34, the pins 32 are shorted through the conductive plastic link 66 to complete the sensor circuit 54 (FIG. 5) disposed within the component 12 associated with the housing 20.

The example housing 20 and header 64 include a mechanical locking feature for preventing undesired disengagement. The example locking feature includes a tab 70 disposed on the header 64 and a clip 72 on the housing. The clip 72 snaps over the ramped tab 70 and seats below a flat portion. Removal of the housing 20 requires the clip 72 to be spread outward over the tab 70. The locking feature is provide to lock at a point after the primary pins 24 are engaged with the sockets 26, but before or concurrently with connection between the sensor pins 32 and the sensor sockets 34.

Figure 10:
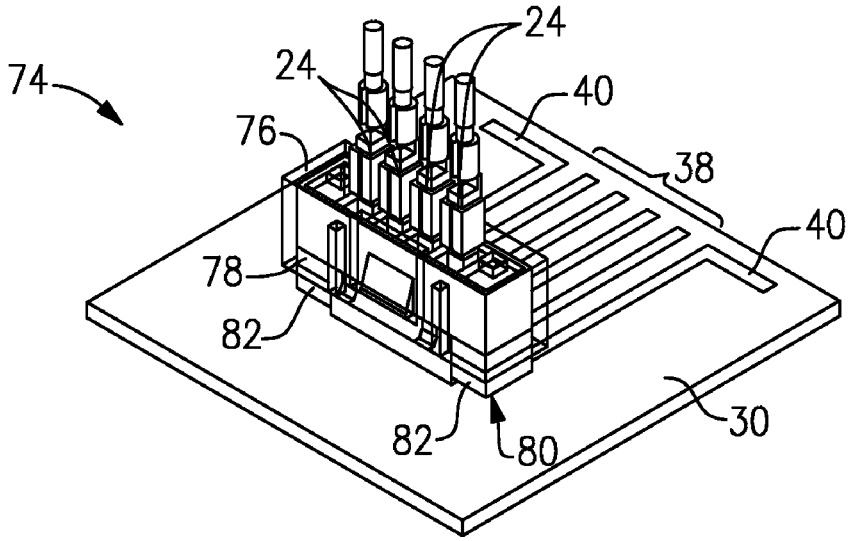
FIG. 10 is perspective view of another example electrical connector assembly including a header and housing with conductive plastic portions.

Referring to FIG. 10, an example connector assembly 74 includes a housing 76 supporting the primary circuit pins 24. No sensor pins are provided. Instead, the housing 76 includes a conductive plastic portion 78. A header 80 includes corresponding conductive plastic portions 82 that are electrically connected to the sensor traces 40. Assembly of the housing 76 to the header 80 engages the conductive plastic portions 78 of the housing 78 with the conductive plastic portions 82 of the header 80. The resulting continuity between the conductive plastic portions 82 completes the circuit as desired.

Figure 11:
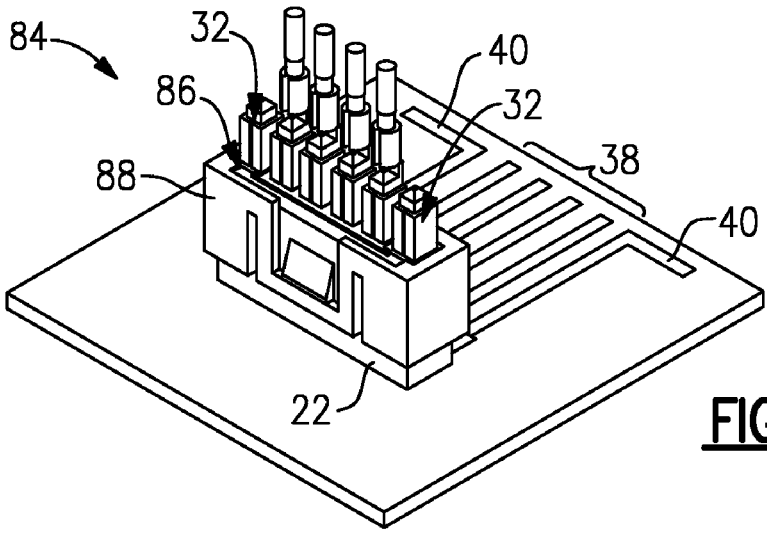
FIG. 11 is a perspective view of another example electrical connector assembly including a housing with a conductive plastic portion.

Referring to FIG. 11, another connector assembly 84 includes a housing 88 with a conductive link 86 comprising a conductive plastic material. The conductive link 86 provides the desired short between the sensor pins 32. The sensor pins 32 disposed within the housing 80 therefore are shorted and complete the connection between the sensor traces 40 on the circuit board 30, once engaged to the sensor sockets 34 (FIG. 4) disposed within the header 22.

Figure 12:
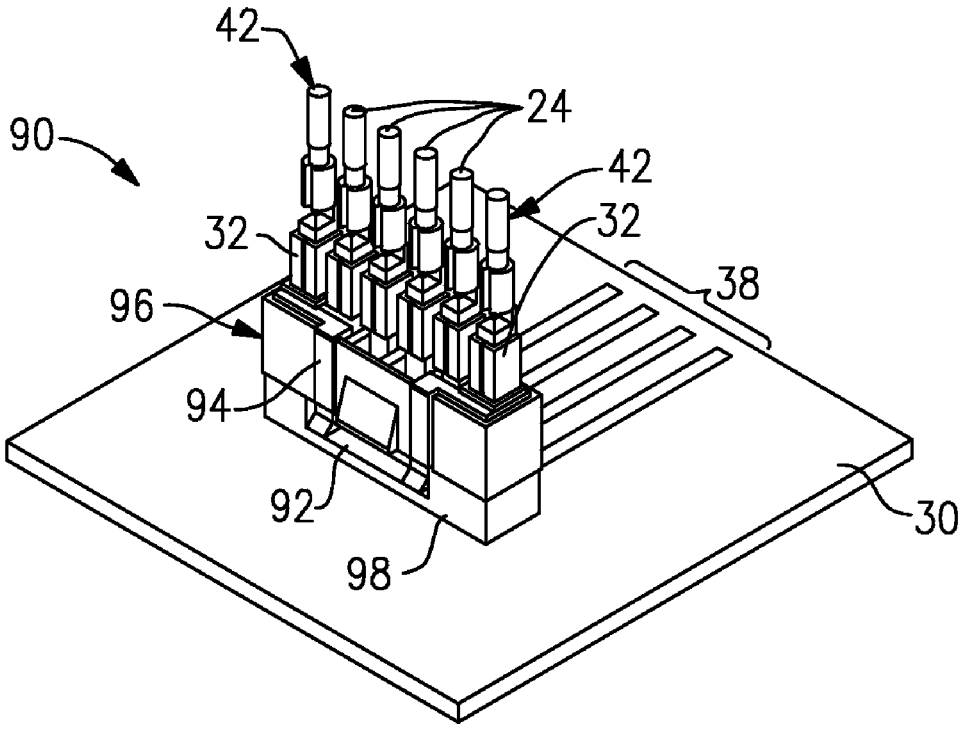
FIG. 12 is a perspective view of another example electrical connector assembly including a housing and header with conductive plastic portions.

Referring to FIG. 12, another connector assembly 90 includes a housing 96 with a conductive link 94 that contacts a conductive portion 92 of the header 98. The connector assembly 90 provides completion of a sensor circuit disposed within a component from which the wires 24 originate. The conductive portion 92 comprises an electrically conductive plastic material. The conductive link 94 on the housing 96 can be of any electrically conductive material. The example conductive link 94 comprises a clip fabricated from an electrically conductive plastic material. The conductive link 94 is disposed within the housing 96 and is in separate electrical contact with each of the sensor pins 32. The conductive link 94 does not short the sensor pins 32. Engagement of the housing 96 with the header 98 facilitates engagement between the conductive link 94 and the conductive portion 92 to short the sensor pins 32 to each other and complete the circuit. As appreciated, the conductive link 92 could also be fabricated from an electrically conductive metal such as copper.

The example disclosed connector assembly provides a positive verification of electrical continuity separate primary circuit connections and also provides a means to verify connector status once the connection is made.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An electrical connection assembly comprising:

a housing formed of non-conductive material supporting a first plurality of primary circuit terminals, wherein the primary circuit terminal for the terminal end of a corresponding plurality of wires;

a header mounted on a circuit board supporting a second plurality of primary circuit terminals electrically connectable to the first plurality of primary circuit terminals, the second plurality of primary circuit terminals forming the electrical terminal end of a corresponding plurality of electric traces disposed on the circuit board;

at least two sensor connections having a first part disposed within the housing and a second part disposed within the header;

a conductive link disposed within the housing for electrically connecting the first parts of the at least two sensor connections; and a sensor circuit that is completed in response to the electrical connection of the first part to the second part of the at least two sensor connections.

2. The assembly as recited in claim 1, wherein the sensor circuit is disposed on the circuit board and comprises at least one indicator that communicates completion of the sensor circuit.

3. The assembly as recited in claim 2, wherein a first part of the sensor circuit is disposed on the circuit board and a second portion of the sensor circuit is disposed in a component associated with the first plurality of primary circuit terminals.

4. The assembly as recited in claim 3, wherein the second parts of the at least two sensor connections are shorted to each other upon connection to the first part of the at least two sensor connections.

5. The assembly as recited in claim 1, wherein the first plurality of primary circuit terminals and the first part of the sensor connections comprise pins, and the second plurality of circuit terminals and the second part of the sensor connections comprise sockets for receiving the pins.

6. The assembly as recited in claim 1, wherein an electrical connection between the first and second plurality of primary circuit terminals is completed before the electrical connection between the at least two sensor connections.

7. The assembly as recited in claim 1, wherein the at least two sensor circuit connections are disposed on distal sides of the housing and header.

8. The assembly as recited in claim 1, wherein the sensor circuit comprises a portion fabricated from a conductive plastic material.

9. The assembly as recited in claim 1, including a first electrical component corresponding with the plurality of wires and a light that is actuateable responsive to an electrical connection between the first plurality of primary circuit terminals and the second plurality of primary circuit terminals.

10. The assembly as recited in claim 9, including a second light disposed on the circuit board that is actuateable responsive to a verified electrical connection between the first an second plurality of primary circuit terminals.

11. An electrical connector assembly comprising:

a housing of non-conductive material supporting a first plurality of primary circuit connections, the primary circuit connections including a first terminal part for terminating a corresponding plurality of wires;

a header mounted on a circuit board supporting a second plurality of primary circuit connections engageable with the primary circuit connections, wherein the second plurality of primary circuit connections comprise a second terminal part that forms a terminal end of a corresponding plurality of circuit traces, the second terminal part electrically connectable with the first terminal part that form an end of ;

two housing sensor terminals disposed on distal ends of the housing from each other and in electrical communication through a conductive link mounted within the housing;

two header sensor terminals disposed on distal ends of the header from each other; and a sensor circuit disposed on the circuit board that is completed responsive to an electrical connection between the two housing sensor terminals and the two header sensor terminals.

12. The assembly as recited in claim 11, wherein the housing is associated with a first electric component and the header is associated with a second component and part of the sensor circuit is disposed in each of the first electric component and the second electric component.

13. The assembly as recited in claim 12, wherein the second electric component comprises a circuit board including the conductive link between the two header sensor terminals.

14. The assembly as recited in claim 13, wherein the first component includes an indicator that is actuated responsive to the sensor circuit being completed upon connection of the housing sensor terminals to the header sensor terminals that are shorted by the conductive link on the circuit board.

15. The assembly as recited in claim 11, wherein the conductive link comprises an electrically conductive plastic material.

16. The assembly as recited in claim 11, wherein the second component includes an indicator that is actuated responsive to the sensor circuit being completed upon connection of the header sensor terminals to the housing sensor terminals that are shorted by the conductive link on the housing.

17. The assembly as recited in claim 11, wherein the first plurality of primary circuit connections supported by the housing are electrically connected to the second plurality of primary circuit connections supported by the header before the housing sensor terminals are electrically connected to the header sensor terminals.

18. The assembly as recited in claim 17, including a locking feature for holding the housing and header together, the locking feature engages after the first plurality of primary circuit connections is electrically connected to the second plurality of primary circuit connections and before electrical connection of the housing sensor connections to the header sensor connections.

19. The assembly as recited in claim 11, wherein the plurality of wires correspond with a first component and the circuit board corresponds with a second component, where each of the first component and the second component include an indicator actuateable responsive to a proper electrical connection between the first and second plurality of primary circuit connections and the at least two housing and sensor terminals.

20. The assembly as recited in claim 19, wherein the indicator includes a light.

21. The assembly as recited in claim 11, wherein the housing is disposed at the end of a cable including the plurality of wires.

* * * * *